US011602949B2

(12) United States Patent
Sattler et al.

(10) Patent No.: US 11,602,949 B2
(45) Date of Patent: Mar. 14, 2023

(54) METHOD FOR MANUFACTURING A VALUE DOCUMENT, VALUE DOCUMENT AND PRINTING DEVICE

(71) Applicant: GIESECKE+DEVRIENT CURRENCY TECHNOLOGY GMBH, Munich (DE)

(72) Inventors: Tobias Sattler, Holzkirchen (DE); Karlheinz Mayer, Grunenbach (DE); Maik Rudolf Johann Scherer, Grainau (DE); Kai Hermann Scherer, Munich (DE); Raphael Dehmel, Neubeuern (DE); Christian Fuhse, Otterfing (DE); Michael Rahm, Bad Tolz (DE); Manfred Heim, Bad Tolz (DE); Matthias Pfeiffer, Munich (DE); Yana Kisselova-Weckerle, Ottobrunn (DE); Thomas Mang, Holzkirchen (DE); Jorg Anders, Ottenhofen (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 15/734,923

(22) PCT Filed: May 28, 2019

(86) PCT No.: PCT/EP2019/000171

§ 371 (c)(1),
(2) Date: Dec. 3, 2020

(87) PCT Pub. No.: WO2019/233624

PCT Pub. Date: Dec. 12, 2019

(65) Prior Publication Data

US 2021/0229484 A1 Jul. 29, 2021

(30) Foreign Application Priority Data

Jun. 5, 2018 (DE) ..... 10 2018 004 433.6

(51) Int. Cl.
*B42D 25/369* (2014.01)
*B42D 25/29* (2014.01)
(Continued)

(52) U.S. Cl.
CPC ..... *B42D 25/369* (2014.10); *B41F 9/002* (2013.01); *B41F 23/08* (2013.01); *B42D 25/29* (2014.10);
(Continued)

(58) Field of Classification Search
CPC .... B42D 25/369; B42D 25/29; B42D 25/324; B42D 25/378; B42D 25/425; B41F 9/002
See application file for complete search history.

(56) References Cited

U.S. PATENT DOCUMENTS 8,333,870 B2 12/2012 Burchard et al.
2003/0175540 A1* 9/2003 White ..... B42D 25/29 428/542.2
(Continued)

FOREIGN PATENT DOCUMENTS

CA 2591982 A1 6/2006
DE 102010035313 A1 3/2012
(Continued)

OTHER PUBLICATIONS

International Search Report and Written Opinion from PCT Application No. PCT/EP2019/000171, dated Aug. 28, 2019.

*Primary Examiner* — David H Banh
(74) *Attorney, Agent, or Firm* — Workman Nydegger

(57) ABSTRACT

A method for manufacturing a value document includes: providing a value document substrate; printing the value document substrate with magnetically orientable effect pigments which are dispersed in a UV-curable lacquer; the step of exposing the lacquer containing the magnetically orientable effect pigments to a dynamic magnetic field; the step of irradiating the lacquer containing the effect pigments with UV radiation; and optionally the step of embossing the cured or at least partially cured UV lacquer.

9 Claims, 3 Drawing Sheets

(51) Int. Cl.

| | |
|---|---|
| ***B42D 25/324*** | (2014.01) |
| ***B42D 25/378*** | (2014.01) |
| ***B42D 25/425*** | (2014.01) |
| ***B41F 9/00*** | (2006.01) |
| ***B41F 23/08*** | (2006.01) |

(52) U.S. Cl.
CPC ..... *B42D 25/324* (2014.10); *B42D 25/378* (2014.10); *B42D 25/425* (2014.10)

(56) References Cited

U.S. PATENT DOCUMENTS

2004/0050269 A1* 3/2004 Adamczyk ..... B41N 1/06 101/150
2005/0142468 A1* 6/2005 Blood ..... G03G 21/043 430/10
2006/0127649 A1 6/2006 Keller et al.
2006/0204724 A1* 9/2006 Argoitia ..... B05D 3/12 428/172
2006/0250656 A1* 11/2006 Plutchak ..... G03G 9/0928 358/3.28
2007/0058227 A1* 3/2007 Raksha ..... B42D 25/369 359/2
2009/0035690 A1* 2/2009 Blood ..... G03G 21/046 430/127
2010/0040845 A1* 2/2010 Schmid ..... B05D 3/207 428/207
2013/0029112 A1* 1/2013 Bargir ..... B42D 25/369 428/195.1
2015/0352883 A1* 12/2015 Schmid ..... H01F 41/16 283/73
2015/0352888 A1* 12/2015 Schmid ..... H01F 7/0273 428/29
2016/0133369 A1* 5/2016 Loginov ..... B05D 5/065 335/306
2016/0339474 A1* 11/2016 Degott ..... H01F 41/16

FOREIGN PATENT DOCUMENTS

WO 2004028825 A2 4/2004
WO 2006066431 A1 6/2006
WO 2014108303 A1 7/2014

* cited by examiner

METHOD FOR MANUFACTURING A VALUE DOCUMENT, VALUE DOCUMENT AND PRINTING DEVICE

FIELD OF THE DISCLOSURE

The invention relates to a method for manufacturing a value document, in particular a bank note, to a value document obtainable by the method and to a printing device for carrying out the method.

Data carriers, such as value documents or identification documents, or other objects of value, such as branded articles, are often provided for safeguarding purposes with security elements which permit a verification of the authenticity of the data carriers and which at the same time serve as protection from unauthorized reproduction. A special role in authentication assurance is played by security elements with viewing angle-dependent effects, because these cannot be reproduced even with the most modern copiers. The security elements are equipped here with optically variable elements which convey a different pictorial impression to the viewer from different viewing angles, showing for example a different color impression or brightness impression and/or a different graphic motif, depending on the viewing angle.

Thin-film systems which produce a viewing angle-dependent color impression for the viewer by means of interference are known in the prior art. This optical effect can serve as an optically variable security element. A large-area thin-film system can be crushed by means of various techniques. The size of the resulting flakes or platelets can be as small as a few micrometers laterally, but the size usually ranges in a region from 2 μm to 100 μm. The vertical structure of a platelet is given by the requirements of the interference layers and is normally as thin as possible, e.g. in a region from 200 nm to 800 nm. Such platelets are employed e.g. in an optically variable ink (so-called OVI ink) which is used for providing a security element.

Further known is the possibility of applying the thin-film systems, which produce a color impression, onto a ferromagnetic material. The pigment platelets hence have a magnetic moment. Magnetically orientable effect pigments are commercially available under the trade name OVMI® of the SICPA company (the abbreviation OVMI stands for "optically variable magnetic ink"). The pigments possess a platelet-shaped construction and are present in the form of a layered composite which often includes two layers of optical effect layers and a magnetic layer embedded in between. With regard to the optical effect layers, metallically mirroring layers as well as color-shifting layer systems, e.g. with an absorber/dielectric/reflector construction, can be considered. The embedded magnetic layer is normally invisible, but is required for the alignment of the pigments.

In the prior art it is further known to utilize such color pigments, which possess a magnetic moment, for providing optically variable security elements. For this purpose, the pigments are incorporated into a transparent binding agent. By means of an external magnetic field the alignment of the pigments can be influenced immediately after the printing on a printing stock. Then, the binding agent is cured, e.g. by means of UV radiation, in order to fix the alignments of the pigments. By skillfully setting the spatial course of the pigment alignments, it is possible to equip the printed substrate with optical motion effects.

SUMMARY

The object of the present invention is to provide a method by which the control over the arrangement of the thin-film pigments or effect pigments of an optically variable ink applied to a printing stock is improved.

1. (First aspect of the invention) A method for manufacturing a value document, e.g. a bank note, comprising a) providing a value document substrate;

b) printing the value document substrate with magnetically orientable effect pigments which are dispersed in a UV-curable lacquer;

c) the step c1) of exposing the lacquer containing the magnetically orientable effect pigments to a dynamic, in particular a rotating, magnetic field, so that the effect pigments in the lacquer arrange themselves parallel to the value document substrate and in particular edge to edge; the step c2) of irradiating the lacquer containing the effect pigments with UV radiation, wherein step c2) in particular is effected after step c1) or is effected simultaneously together with step c1).

It is preferred that step c2) is carried out after step c1).

The value document substrate provided in step a) is in particular a paper substrate, a plastic substrate, a foil/paper/foil composite substrate (see e.g. WO 2006/066431 A1) or a paper/foil/paper composite substrate (see e.g. WO 2004/028825 A2).

According to a variant, the value document substrate provided in step a) is a foil substrate for manufacturing security strips, security threads or security patches or security labels that are suitable for safeguarding value documents, e.g. bank notes.

The magnetic field can be produced e.g. by an electromagnet. It is advantageous here that the different magnetic field vectors are parallel to the value document substrate. This causes the pigments to align themselves, as desired, parallel to the value document substrate.

According to a special implementation variant, there is the possibility to utilize a thermoplastic UV lacquer. In this case it is advantageous to use a heated embossing tool. As an alternative to the thermoplastic UV lacquer, a thermoplastically deformable layer obtainable by printing technology could be present beneath the lacquer containing the magnetically orientable effect pigments.

2. (Preferred configuration) The method according to clause 1, additionally comprising d) the step of embossing the cured or at least partially cured UV lacquer, which has the effect pigments which are arranged parallel to the value document substrate and in particular edge to edge, so that an embossed relief structure with effect pigments adapting to the relief is formed in the lacquer, conveying to the viewer an optically variable image.

In the event that in step d) an embossing of a UV lacquer which is only partially cured is effected, it is expedient to carry out, in an additional step, e) a complete curing after the embossing or during the embossing.

3. (Preferred configuration) The method according to clause 1 or 2, wherein the dynamic, in particular rotating, magnetic field in step c) is a continuously rotating magnetic field which preferably has a speed in the region of 50 revolutions per minute to 1500 revolutions per minute, more preferably a speed in the region of 100 revolutions to 1500 revolutions per minute and particularly preferably a speed in the region of 100 revolutions per minute to 500 revolutions per minute.

4. (Preferred configuration) The method according to clause 1, 2 or 3, wherein the step of embossing d) is effected by means of an intaglio printing plate.

5. (Preferred configuration) The method according to any of clauses 1 to 4, wherein the step b) of printing the value document substrate with magnetically orientable effect pigments which are dispersed in a UV-curable lacquer is effected in a selected region which is present in particular in the form of a pattern, in the form of characters or in the form of a coding.

6. (Preferred configuration) The method according to any of clauses 1 to 5, wherein the step c) has the following (sub)steps:

c) the step c1a) of exposing the lacquer containing the magnetically orientable effect pigments to a dynamic, in particular a rotating, magnetic field, so that the effect pigments in the lacquer arrange themselves parallel to the value document substrate and in particular edge to edge, in order to arrange the effect pigments in this way in the form of a pre-orientation; the step c1b) in which a further orienting or aligning of the magnetically orientable effect pigments pre-oriented in the course of step c1a) is effected by applying a static magnetic field so that the effect pigments assume an orientation changed against the pre-orientation; the step c2) of irradiating the lacquer containing the effect pigments with UV radiation, wherein step c2) in particular is effected after steps c1a) and c1b).

Optionally, the additional step d) can be effected, namely d) the step of embossing the cured or at least partially cured UV lacquer, which has the pre-oriented effect pigments which first are arranged parallel to the value document substrate and in particular edge to edge and subsequently has effect pigments subjected to a changed orientation, so that an embossed relief structure with effect pigments adapting to the relief is formed in the lacquer, conveying to the viewer an optically variable image.

7. (Second aspect of the invention) A value document, in particular a bank note, obtainable by the method according to any of clauses 1 to 6.

The value document may in particular be a paper bank note, polymer bank note or foil composite bank note, or an identity card or passport data page.

8. (Third aspect of the invention) A printing device for carrying out the method according to any of clauses 1 to 6, comprising an apparatus for providing a value document substrate, an apparatus for printing the value document substrate with a UV-curable lacquer based on magnetically orientable effect pigments, an apparatus for providing a dynamic, in particular rotating, magnetic field which is suitable for aligning the effect pigments, an apparatus for curing the UV lacquer by means of UV radiation and an apparatus for embossing the cured or at least partially cured UV lacquer.

9. (Preferred configuration) A printing device according to clause 8, wherein the apparatus for embossing is an intaglio printing plate.

In the present description, instead of the formulation "magnetically orientable effect pigments" the abbreviation OVMI® pigments is used. The pigments possess a platelet-shaped structure. The abbreviation OVI® stands for optically variable ink, OVI® pigments mean effect pigments or thin-film pigments of an optically variable ink.

BRIEF DESCRIPTION OF THE DRAWINGS

The advantages of the invention will be explained hereinafter with reference to the strongly simplified Figures, in whose representation a rendition that is true to scale and to proportion has been dispensed with in order to increase clearness.

There are shown.

DETAILED DESCRIPTION OF VARIOUS EMBODIMENTS

Figure 1:
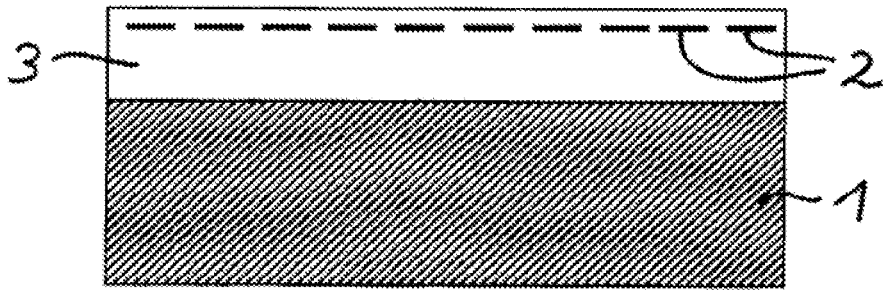
FIG. 1 the alignment of "leafing" pigments in a lacquer applied to a printing stock.
Figure 2:
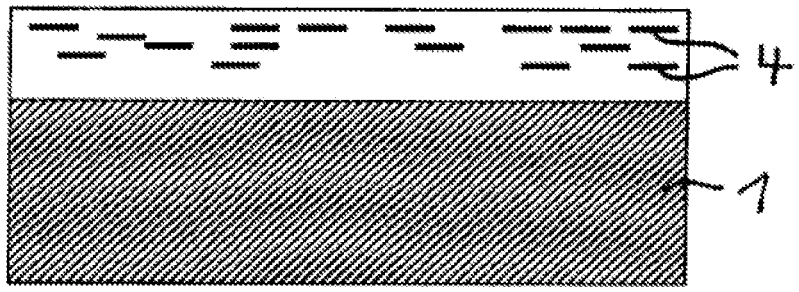
FIG. 2 the alignment of "non-leafing" pigments in a lacquer applied to a printing stock.

The method according to the invention preferably includes the embossing of a dispersion solution which contains thin-film pigments. It is known in the prior art that the alignment of the pigments of an optically variable ink (OVI® pigments) in the dispersion medium is based on the complex interaction of various factors such as the viscosity of the medium and shrinkage during drying. If the manufacturing parameters are chosen correctly, it is possible that the pigments align themselves approximately parallel to the boundary area of the dispersion medium. A distinction is made between "leafing" pigments and "non-leafing" pigments: "Leafing" pigments move towards the surface of the dispersion medium after the application to a printing stock (see FIG. 1; reference number 1 refers to the value document substrate, in the example a paper substrate; reference number 2 refers to "leafing" pigments; reference number 3 refers to the dispersion medium, e.g. a UV-curable lacquer), whereas "non-leafing" pigments 4 (see FIG. 2) spread randomly and at different heights within the dispersion medium.

"Leafing" pigments can arrange themselves at the boundary layer "substrate—lacquer" as well as at the boundary layer "lacquer—air".

Advantageously, the dispersion medium meets the following requirements:

1) embossability of the cured or at least partially cured UV lacquer;

2) controlled curability by UV radiation.

In the following, the combination of dispersion medium (UV-curing lacquer) and OVI® pigments is referred to as "OVI embossing lacquer".

It is preferred to apply the OVI embossing lacquer uniformly onto the value document substrate to be printed.

Figure 3:
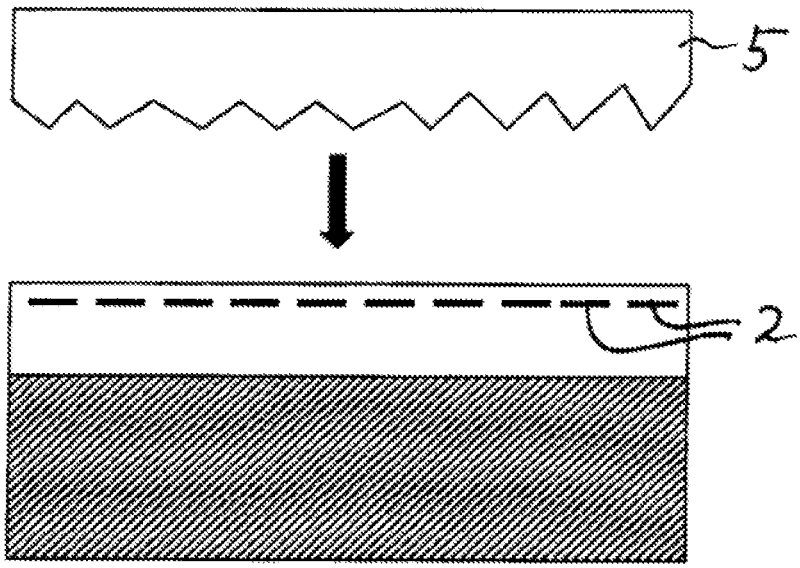
FIG. 3 the arrangement of pigments in a lacquer applied to a printing stock, before the embossing operation.

For embossing the OVI embossing lacquer, a suitable embossing tool 5 must be used (see FIG. 3). The lower limit for the dimensions of the embossing structure is given in particular by the size of the pigments 2 (in the example "leafing" pigments), e.g. in a region from 2 μm to 100 μm. According to one variant, the pigments which are present in a relatively large dimension (i.e. in a dimension larger than the dimensions of the embossing structure) can be broken up into smaller fragments during embossing.

Figure 4:
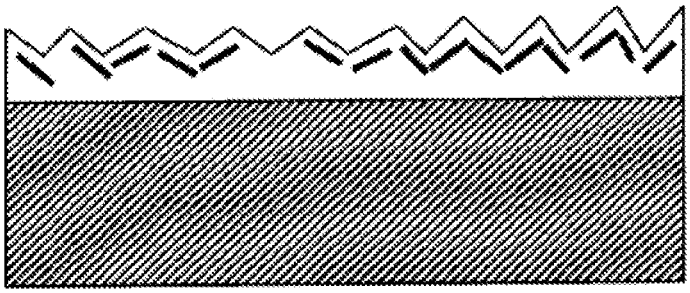
FIG. 4 the arrangement of pigments in a lacquer applied to a printing stock, after the embossing operation.

If the OVI embossing lacquer is now embossed, the local layer height of the lacquer changes: in some places the OVI embossing lacquer is strongly pressed in by the embossing structure of the embossing tool and the layer height is reduced. In other words, a transfer of the OVI embossing lacquer takes place, which leads to a local fluid dynamic of the embossing lacquer: a buoyancy gradient arises, i.e. at embossed depressions the buoyancy which acts on the pigments is less strong than at elevations. Therefore, the pigments at the places where the embossing lacquer is strongly pressed in move downwards, whereas the pigments at the places where the embossing structure has an elevation move upwards (or the pigments move less strongly downwards). The movement can also be different along a pigment, which results in an inclination of the pigment. Thus, the pigments are aligned along the orientation of the embossing structure located immediately above (see FIG. 4). The pigments follow the embossing structure of the lacquer.

Still during the embossing operation, or even before the embossing operation, the OVI embossing lacquer can be completely cured by UV radiation. In this way, the pigments are immobilized and fixed with regard to their final alignment.

Since the embossing structure of the embossing tool can be manufactured with a high degree of freedom of design, e.g. by milling, 3D printing, lithography or the like, the method makes possible a high level of detail.

In particular, embossing structures can easily be manufactured such that neighboring flanks have slopes that differ greatly from one another.

Hereinafter, a method for manufacturing a value document, e.g. a bank note, is described, comprising a) providing a value document substrate;

b) printing the value document substrate with magnetically orientable effect pigments or OVMI® pigments which are dispersed in a UV-curable lacquer;

c) the step c1) of exposing the lacquer containing the magnetically orientable effect pigments to a dynamic, in particular rotating, magnetic field, so that the effect pigments in the lacquer arrange themselves parallel to the value document substrate and in particular edge to edge; the step c2) of irradiating the lacquer containing the effect pigments with UV radiation, wherein c2) in particular is effected after step c1) or is effected simultaneously together with step c1);

optionally d) the step of embossing the cured or at least partially cured UV lacquer, which has the effect pigments which are arranged parallel to the value document substrate and in particular edge to edge, so that an embossed relief structure with effect pigments adapting to the relief is formed in the lacquer, conveying to the viewer an optically variable image.

The combination of dispersion medium (UV-curing lacquer) and OVMI® pigments herein is also referred to as "OVMI embossing lacquer".

Figure 5:
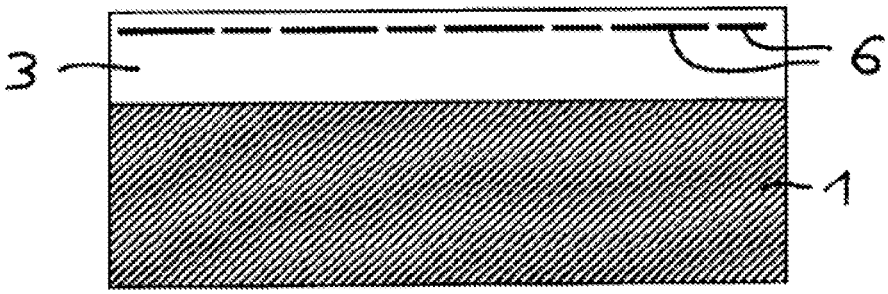
FIG. 5 the alignment of OVMI® pigments dispersed in a UV-curable lacquer, which are exposed to a rotating magnetic field, when viewed in cross-sectional view.

FIG. 5 illustrates the alignment of OVMI® pigments 6 dispersed in a UV-curable lacquer 3, which are exposed to a rotating magnetic field, when viewed in a cross-sectional view. Reference number 1 refers to the value document substrate, in the example a paper substrate. The UV-curable lacquer 3, which comprises the OVMI® pigments 6, was applied to the paper substrate 1 by screen printing. The rotating magnetic field is produced by means of a magnetic stirrer (not shown in FIG. 5) arranged underneath the paper substrate 1 and in the example is a continuously rotating magnetic field with a speed of 150 revolutions per minute. Due to the rotating magnetic field, the OVMI® pigments 6 form a substantially homogeneous, mirroring area. The arrangement of the individual OVMI® pigments is effected so to speak "edge to edge".

Figure 6:
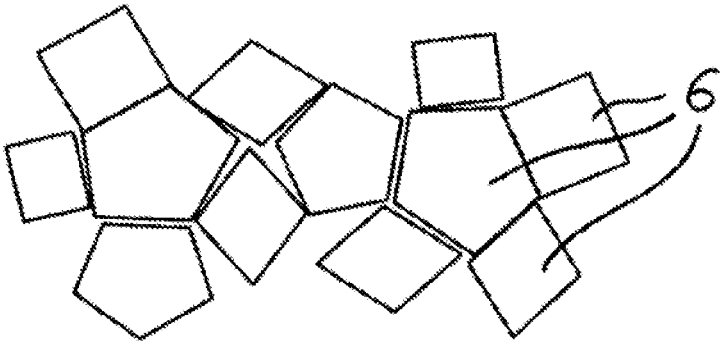
FIG. 6 the orientation of OVMI® pigments dispersed in a UV-curable lacquer, which are exposed to a rotating magnetic field, when viewed in plan view.

FIG. 6 shows a detail of the "edge-to-edge" alignment of OVMI® pigments 6 dispersed in a UV-curable lacquer, which alignment can be recognized under the microscope, which pigments are exposed to a rotating magnetic field, when viewed in plan view.

Figure 7:
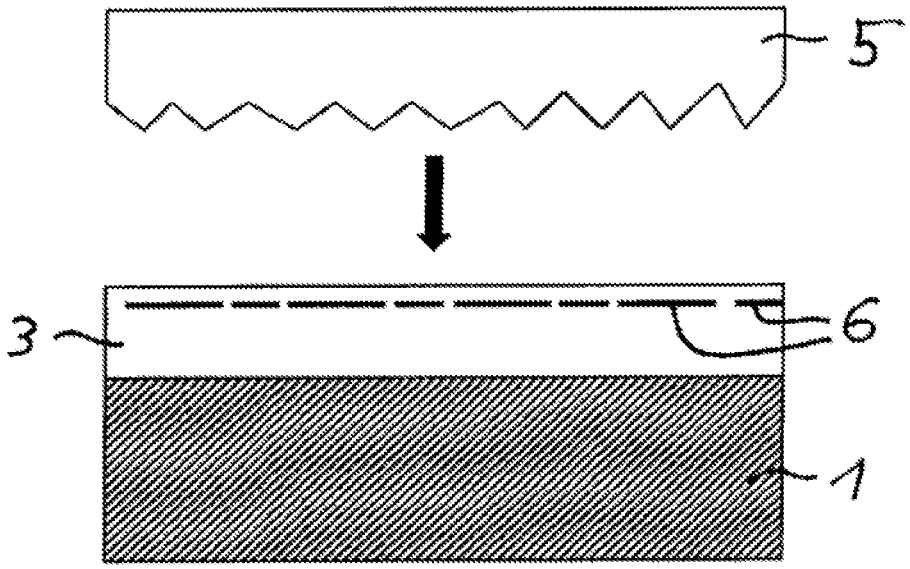
FIGS. 7 and 8 the arrangement of OVMI pigments, which are exposed to a rotating magnetic field, in a UV-curable lacquer applied to a printing stock, respectively before and after the embossing operation.
Figure 8:
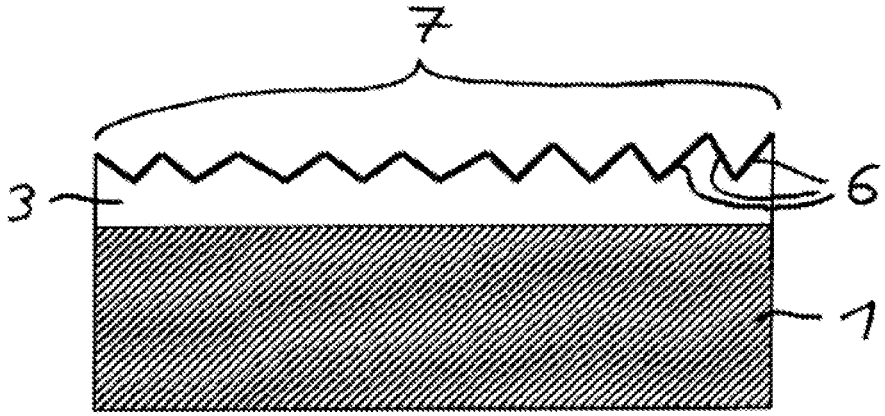

According to FIGS. 7 and 8, besides the step c1) of exposing the UV-curable lacquer 3 containing the magnetically orientable effect pigments 6 to a rotating magnetic field so that the effect pigments 6 in the lacquer 3 arrange themselves edge to edge along the area of the value document substrate 1, there is simultaneously effected the step c2) of irradiating the lacquer 3 containing the effect pigments 6 with UV radiation. Depending on the duration or dose of the UV treatment, the UV irradiation leads to a cured or at least partially cured UV lacquer 3 which has the effect pigments 6 which are arranged edge to edge along the area of the value document substrate 1. In the step of embossing by means of an embossing tool 5, e.g. an intaglio printing plate, an embossed relief structure 7 with effect pigments 8 adapting to the relief is formed in the lacquer 3, conveying to the viewer an optically variable image.

The method according to the invention, because of the interaction of the four measures 1) OVMI® pigments, 2) dynamic, in particular rotating, magnetic field, 3) UV irradiation and 4) embossing, makes possible an extremely advantageous control of the pigment alignments, so that in particular homogeneously lustrous, structured surfaces can be imitated. A granular, noisy texture, which is known in the prior art, can also be produced.

According to a preferred variant, the method according to the invention includes the following steps:

a) providing a value document substrate;

b) printing the value document substrate with magnetically orientable effect pigments which are dispersed in a UV-curable lacquer;

c) the step c1a) of exposing the lacquer containing the magnetically orientable effect pigments to a dynamic, in particular a rotating, magnetic field, so that the effect pigments in the lacquer arrange themselves parallel to the value document substrate and in particular edge to edge, in order to arrange the effect pigments in this way in the form of a pre-orientation; the step c1b) in which a further orienting or aligning of the magnetically orientable effect pigments pre-oriented in the course of step c1a) is effected by applying a static magnetic field so that the effect pigments assume an orientation changed against the pre-orientation; the step c2) of irradiating the lacquer containing the effect pigments with UV radiation, wherein step c2) in particular is effected after steps c1a) and c1b);

optionally, d) the step of embossing the cured or at least partially cured UV lacquer, which has the pre-oriented effect pigments which first are arranged parallel to the value document substrate and in particular edge to edge and subsequently has effect pigments subjected to a changed orientation, so that an embossed relief structure with effect pigments adapting to the relief is formed in the lacquer, conveying to the viewer an optically variable image.

The preferred variant achieves a particular attractiveness and brilliance of the ink layer having the effect pigments. The effects obtained are due to the fact that the effect pigments in the alternating field change not only their alignment (i.e. the tilt angle) but also their arrangement (i.e. the position in the lacquer). In the case of a rotating bar magnet, the effect pigments appear to accumulate in one plane and arrange themselves "edge to edge". The effect pigments thus form a layer that is as closed as possible, which leads to an increased utilizable reflecting area and thus to increased brilliance. In this way, further, the quantity of effect pigments to be employed can be reduced.

The invention claimed is:

1. A method for manufacturing a value document, comprising:

a) providing a value document substrate;

b) printing the value document substrate with magnetically orientable effect pigments which are dispersed in a UV-curable lacquer;

c) the step c1) of exposing the lacquer containing the magnetically orientable effect pigments to a dynamic, in particular a rotating, magnetic field, so that the effect pigments in the lacquer arrange themselves parallel to the value document substrate and in particular edge to edge;

the step c2) of irradiating the lacquer containing the effect pigments with UV radiation, wherein step c2) in particular is effected after step c1) or is effected simultaneously together with step c1), and d) embossing the cured or at least partially cured UV lacquer, which has the effect pigments which are arranged parallel to the value document substrate and in particular edge to edge, so that an embossed relief structure is formed in the lacquer with effect pigments moved by the embossing to adapt to a pattern of the relief, conveying to the viewer an optically variable image.

2. The method according to claim 1, wherein the dynamic, in particular rotating, magnetic field in step e) is a continuously rotating magnetic field which preferably has a speed in the region of 50 revolutions per minute to 1500 revolutions per minute, more preferably a speed in the region of 100 revolutions to 1500 revolutions per minute and particularly preferably a speed in the region of 100 revolutions per minute to 500 revolutions per minute.

3. The method according to claim 1, wherein the step of embossing d) is effected by means of an intaglio printing plate.

4. The method according to claim 1, wherein the step b) of printing the value document substrate with magnetically orientable effect pigments which are dispersed in a UV-curable lacquer is effected in a selected region which is present in particular in the form of a pattern, in the form of characters or in the form of a coding.

5. The method according to claim 1, wherein the step c) has the following (sub)steps:

c) the step c1a) of exposing the lacquer containing the magnetically orientable effect pigments to a dynamic, in particular a rotating, magnetic field, so that the effect pigments in the lacquer arrange themselves parallel to the value document substrate and in particular edge to edge, in order to arrange the effect pigments in this way in the form of a pre-orientation;

the step c1b) in which a further orienting or aligning of the magnetically orientable effect pigments pre-oriented in the course of step c1a) is effected by applying a static magnetic field so that the effect pigments assume an orientation changed against the pre-orientation; the step c2) of irradiating the lacquer containing the effect pigments with UV radiation, wherein step c2) in particular is effected after steps c1a) and c1b).

6. The method according to claim 5, additionally comprising step d) of embossing the cured or at least partially cured UV lacquer, which has the pre-oriented effect pigments which first are arranged parallel to the value document substrate and in particular edge to edge and subsequently has effect pigments subjected to a changed orientation, so that an embossed relief structure with effect pigments adapting to the relief is formed in the lacquer, conveying to the viewer an optically variable image.

7. A value document obtained according to method of claim 1, the value document comprising:

a value document substrate;

magnetically orientable effect pigments dispersed in an at least partially cured UV lacquer arranged on the value document substrate;

wherein the UV lacquer is embossed with a relief structure formed in the lacquer such that the effect pigments are moved by the embossing to adapt a pattern of the relief from being parallel to the value document substrate, the effect pigments aligned following an orientation of the pattern of the relief and conveying to the viewer an optically variable image.

8. A printing device, comprising:

an apparatus for providing a value document substrate, an apparatus for printing the value document substrate with a UV-curable lacquer based on magnetically orientable effect pigments, an apparatus for providing a dynamic, in particular rotating, magnetic field which is suitable for aligning the effect pigments parallel to the value document substrate and in particular edge to edge, an apparatus for curing the UV lacquer by means of UV radiation, and an apparatus for embossing the cured or at least partially cured UV lacquer so that an embossed relief structure is formed in the lacquer with effect pigments moved by the embossing to adapt to a pattern of the relief, conveying to the viewer an optically variable image.

9. The printing device according to claim 8, wherein the apparatus for embossing is an intaglio printing plate.

* * * * *